US005557856A

United States Patent [19]

Kerttula

[11] Patent Number: 5,557,856

[45] Date of Patent: Sep. 24, 1996

[54] ARRANGEMENT FOR THE SPACE UNDERNEATH A DRYER SECTION OF A PAPER MACHINE

[75] Inventor: Reima Kerttula, Muurame, Finland

[73] Assignee: Valmet Corporation, Helsinki, Finland

[21] Appl. No.: 230,059

[22] Filed: Apr. 20, 1994

[30] Foreign Application Priority Data

Nov. 30, 1993 [FI] Finland ..... 935339

[51] Int. Cl.[6] ..... D06F 58/00

[52] U.S. Cl. ..... 34/117

[58] Field of Search ..... 34/117

[56] References Cited

U.S. PATENT DOCUMENTS

| | | | |
|---|---|---|---|
| 5,144,758 | 9/1982 | Skaugen et al. | 34/117 |
| 5,175,945 | 1/1993 | Skaugen et al. | 34/117 |
| 5,269,074 | 12/1993 | Sims et al. | 34/117 |
| 5,388,347 | 2/1995 | Kerttula et al. | 34/117 |
| 5,426,867 | 6/1995 | Yli-Kauppila et al. | 34/117 |

*Primary Examiner*—John T. Kwon

*Attorney, Agent, or Firm*—Steinberg, Raskin & Davidson P.C.

[57] ABSTRACT

An arrangement in a paper machine dryer section for separating moist dryer section from dry, useful spaces situated underneath the dryer section of the paper machine. Horizontal beams that support the frame of the dryer section of the paper machine are positioned above, or in the upper part of, the space underneath the dryer section. The horizontal beams are supported by vertical beams. The dryer section is surrounded by a hood placed above the floor level of the paper machine hall and which confines the moist spaces of the dryer section in its interior. Underneath the dryer section, a horizontal partition-wall construction is arranged to separate the moist hood spaces of the dryer section from dry, useful spaces situated underneath the moist hood spaces. Conveyor devices for disposing paper broke are arranged above the partition-wall construction. The dry, useful spaces are arranged to be storage spaces and/or installation spaces for one or more other suitable devices of the paper machine.

15 Claims, 4 Drawing Sheets

ARRANGEMENT FOR THE SPACE UNDERNEATH A DRYER SECTION OF A PAPER MACHINE

BACKGROUND OF THE INVENTION

The present invention relates to an arrangement in a paper machine dryer section for spaces situated underneath the dryer section of the paper machine. Horizontal beams or equivalent are arranged above, or in the upper part of, the space underneath the dryer section in the paper machine hall and support the frame of the dryer section of the paper machine. The horizontal beams are supported by vertical beams. The dryer section is surrounded by a hood placed above the floor level of the paper machine hall. The hood surrounds the dryer section and confines the moist spaces of the dryer section in an interior of the hood. The present invention also relates to a dryer section including such an arrangement.

In the prior art, on the floor of the basement spaces situated underneath the dryer section of the paper machine, a broke conveyor is arranged to carry portions of the paper web that fall down from the dryer section, in the event of a break in the web, into as associated pulper. The paper falling down from the dryer section onto the broke conveyor completely occupies the basement space so that no other equipment can be placed there. Also, equipment is not usually placed in the basement spaces since the basement spaces are moist and hot. In the prior art, the basement spaces consist of a space substantially unified with, i.e., communicating with, the interior space of the hood placed on the dryer section above the floor level of the paper machine hall, so that in the basement spaces, there is substantially the same moist and hot atmosphere as in the interior space in the hood. Conventionally, the basement space is provided with a so-called basement hood, by whose means, together with the hood placed above the floor level, the moist and hot spaces of the dryer section are isolated from the paper machine hall and from the rest of the environment. In a manner in itself known, the hood spaces are provided with ventilation and heat-recovery means.

With the exception of the removal of the paper broke, in the prior art, the basement spaces placed underneath the dryer section mostly consist of unused and wasted space, which must, moreover, also be provided with the basement hood. Typically, the dimensions of the basement spaces for an average dryer section are about 5 m×10 m×80 m (about 4,000 cu.m.)

When dryer groups having a twin-wire draw are used in the dryer section in the manner known from the prior art, an upper portion of the basement space is needed for the runs of the loops of the lower drying wires and for the alignment rolls. In recent years, increasing use has been made of single-wire draw and, in connection with it, so-called normal groups, in which the drying cylinders are arranged in the upper row and the reversing suction rolls or cylinders are arranged in the lower row. In this case, the loops of the drying wires run above the drying groups and an increased amount of useless wasted space remains in the basement.

Further, in the prior art, it is usually one manufacturer that supplies the dryer section of the paper machine, and another supplier that constructs the basement space underneath the dryer section so that the overall construction of a paper machine hall is not always as easy and flawless as might be possible.

As known in the prior art, the hydraulic central units of the dryer section of the paper machine and related devices, such as the press section and the calender, are placed at the side of the paper machine hall. A corresponding arrangement is also used in respect of the means of circulation lubrication. These prior art arrangements involve the drawback that they require very long pipelines and/or fluid conduits to the hydraulic actuators and to the points of lubrication. It is a further drawback that, in their typical locations, the hydraulic central units and the lubrication units are relatively unprotected and susceptible of, e.g., impacts from trucks. The long pipelines also require due protection.

OBJECTS AND SUMMARY OF THE INVENTION

Accordingly, it is an object of the present invention to provide novel solutions for the problems discussed above.

It is another object of the present invention to provide a novel solution to advantageously use the basement space underneath the dryer section of a paper machine, in which the basement space can be utilized more efficiently than in the prior art.

It is a further object of the invention to provide such a solution of the basement space for the dryer section in the paper machine hall in which the same supplier can supply both the dryer section and its foundation constructions so that these constructions can be integrated with one another better than in the prior art, the basement spaces can be utilized more efficiently and that the other requirements of space in the paper machine hall can be reduced, and so that a number of different constructions of the paper machine can be simplified and the space requirement of the paper machine hall can be reduced.

In view of achieving the objects stated above, those that will come out later, and others, in the invention a substantially horizontal partition-wall construction is placed underneath the dryer section. By means of the horizontal partition wall, the moist hood spaces of the dryer section are separated from the dry, useful spaces situated underneath the hood spaces. The conveyor means for the disposal of paper broke are arranged above the partition-wall construction. The thus-formed dry useful spaces are arranged to be storage spaces and/or spaces for installation for one or several suitable devices of the paper machine.

In the invention, the removal of broke has been arranged to be conducted above the useful spaces thus-provided underneath the dryer section. The useful spaces are arranged to constitute spaces sealed against water and moisture, and they may favorably be provided with a steel base.

In accordance with the invention, an abundance of such new useful space can be provided underneath the dryer section, which space may also be air-conditioned if necessary. In these useful spaces, it is possible to place one or several of the following devices: hydraulic central units for a variable-crown roll or rolls in the press section of the paper machine, hydraulic central units for the wet end of the paper machine, circulation lubrication centers for the dry end of the paper machine, hydraulic central units for the dry end of the paper machine, centers for the heating of the circulation fluid for calender rolls, blowers and air ducts for the air-conditioning of the paper machine hall and/or the hood of the dryer section, felt storage spaces, measurement and/or regulation central units for the paper machine, and/or control cables and electric cables for measurement detectors, actuators, and/or electric motors. Other types of paper-making machinery can obviously be placed in the thus provided useful spaces.

Further, in the invention, it is an advantage that the devices mentioned above can be fitted underneath the dryer section at such a location from which pipelines, fluid conduits or cables can be drawn as short as possible to the various objects, such as hydraulic actuators, circulation lubrication points, measurement detectors, regulation devices, electric motors, and/or calender rolls.

The steel columns present in the useful spaces (i.e., at least some of the vertical beams supporting the horizontal beams and floor of the paper machine hall) can be hollow box beams which are used advantageously as air ducts, e.g., for air-conditioning the hood placed above the dryer section and/or of the paper machine hall. Blowers are connected to the box beams and provide a flow of air through the hollow interior of the box beams which is then passed through aperture(s) into the hood spaces or the machine hall.

The dryer section of a paper machine in accordance with the invention, comprises dryer groups having drying cylinders, leading rolls and a drying wire carrying a paper web around the drying cylinders and the leading rolls, a hood surrounding the dryer groups and confining moist spaces of the dryer section in an interior thereof, and partition means arranged underneath the dryer groups for separating the moist hood spaces from dry spaces defined underneath the dryer section. The dry, useful spaces are arranged as storage spaces and/or installation spaces for accessory devices of the paper machine. Conveyor means for disposing of paper broke from the web passing through the dryer section are arranged above the partition means. The partition means preferably are a substantially horizontal partition-wall construction extending substantially across the entire length of the dryer section whereby the dry spaces are situated below the partition-wall construction.

In a preferred embodiment, the dryer section includes at least one inverted dryer group having a single-wire draw in which drying cylinders are arranged in a lower row below leading rolls arranged in an upper row, and a basement hood positioned below the inverted dryer group for isolating moist spaces in proximity to the inverted dryer group and the dryer section from the dry spaces. An interior of the basement hood communicates with the interior of the hood about the dryer groups. The basement hood may divide the space underneath the dryer section into at least two parts located on opposite sides thereof, in which case, the conveyor means comprise a broke conveyor arranged in each part.

In the following, the invention will be described in detail with reference to some exemplifying embodiments of the present invention illustrated in the figures in the accompanying drawing. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
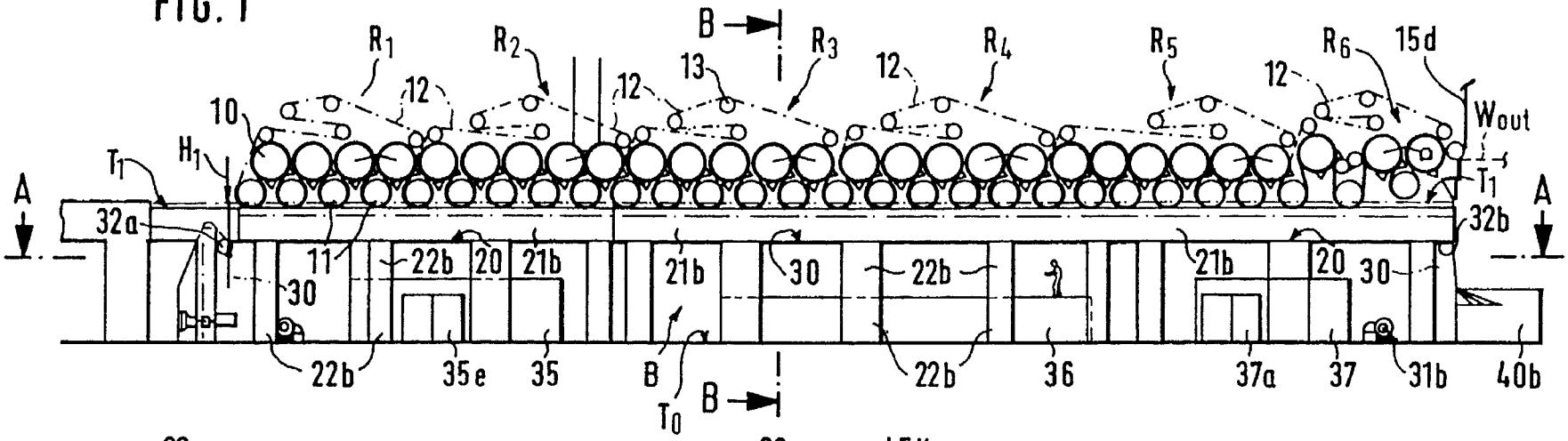
FIG. 1 is a schematic side view of a dryer section of a paper machine that is provided with the arrangement in accordance with the present invention for the space situated underneath the dryer section.
Figure 1A:
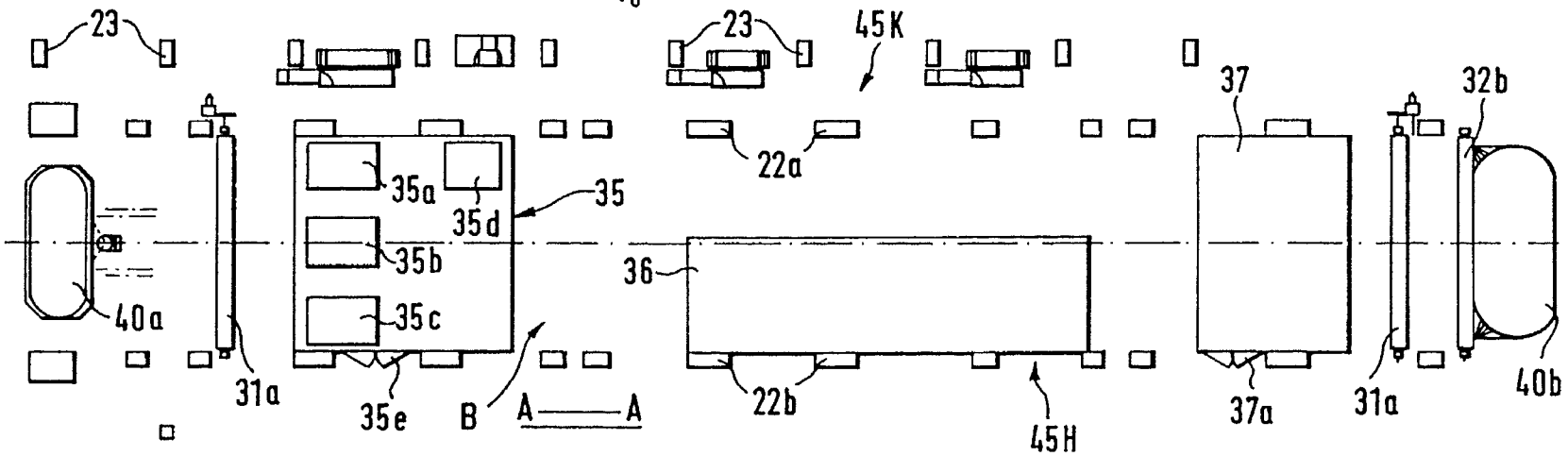
FIG. 1A is a horizontal sectional view taken along the line A—A in FIG. 1.
Figure 2:
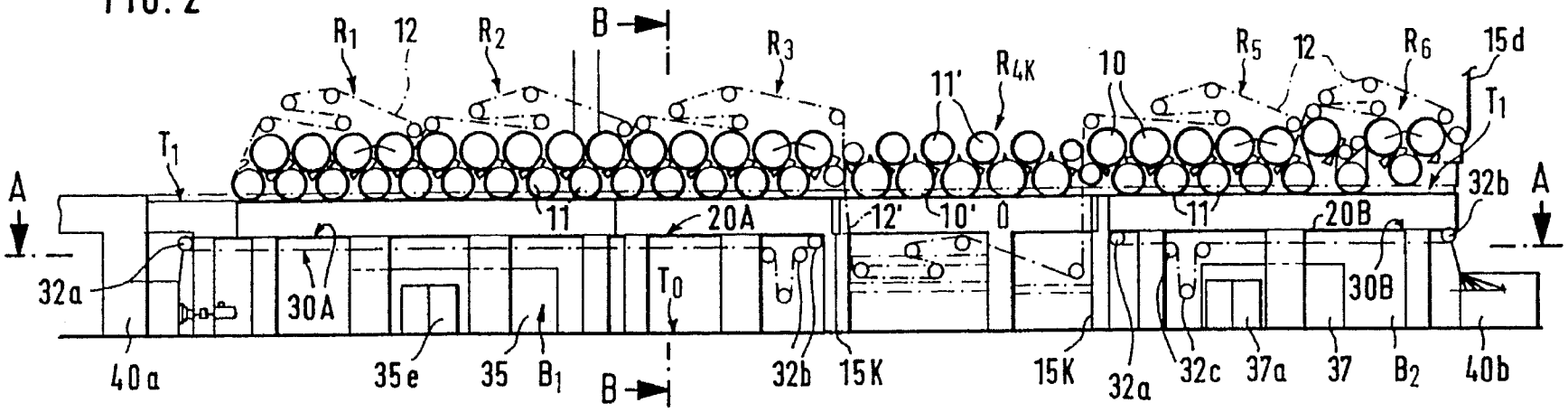
FIG. 2 shows, in a manner corresponding to FIG. 1, a second embodiment in accordance with the invention for the basement space underneath the dryer section.
Figure 3:
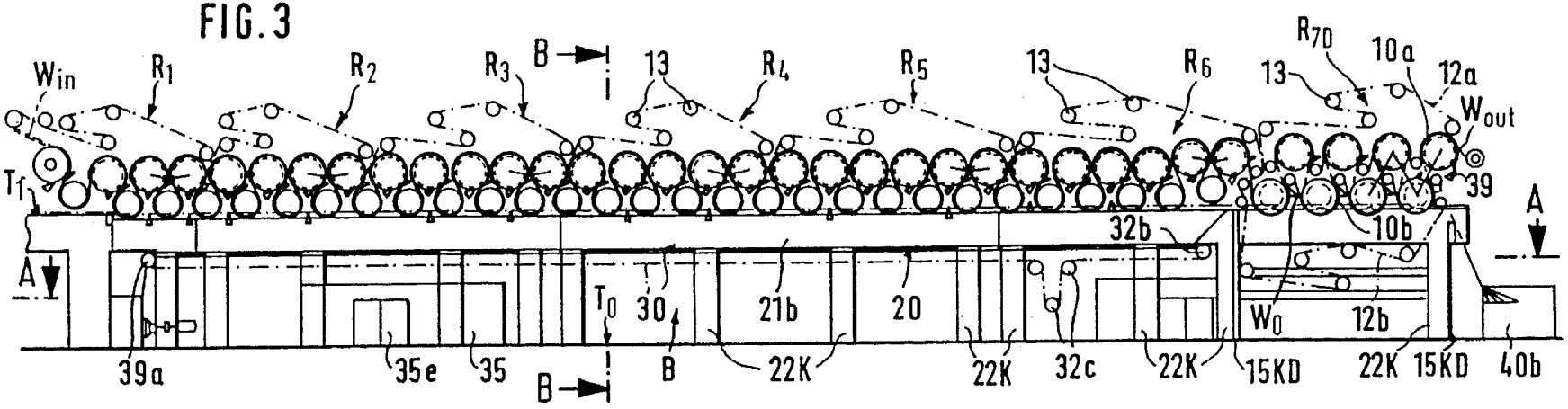
FIG. 3 shows a third embodiment in accordance with the invention for the basement space underneath the dryer section.

Referring to the drawings wherein the same reference numerals refer to the same elements, the dryer section shown in FIGS. 1, 2 and 3 comprises successive dryer groups $R_1$, $R_2$, $R_3$, etc. having a single-wire draw placed in the dryer section. In the dryer groups, there are steam-heated contact-drying cylinders 10 and reversing suction cylinders 11 arranged in substantially horizontal rows. A paper web $W_{in}$, $W_{out}$ to be dried runs from a first drying cylinder 10 onto the next cylinder on support of a drying wire 12, remaining at the side of the outside curve on the reversing suction cylinders 11. In FIG. 1, all the drying groups $R_1, \ldots, R_6$ are so-called normal groups with single-wire draw, in which the steam heated contact-drying cylinders 10 are arranged in the upper row and the reversing suction cylinders 11 are arranged in the lower row. The loops of the drying wires 12 running above the rows of cylinders 10 are guided by guide rolls 13.

In the dryer section as shown in FIG. 2, there are three so-called normal groups $R_1$, $R_2$ and $R_3$ with single-wire draw, in which the drying cylinders 10 are placed in the upper row and the reversing suction cylinders 11 are placed in the lower row. In FIG. 2, the fourth group $R_{4K}$ is a so-called inverted group in which drying cylinders 10' are arranged in the lower row and the reversing suction cylinders 11' are arranged in the upper row. The group $R_{4K}$ is followed by two normal groups $R_5$ and $R_6$ with a single-wire draw.

In the dryer section shown in FIG. 3, there are six normal groups $R_1, \ldots, R_6$ with a single-wire draw, which are followed by one single group $R_{7D}$ having a twin-wire draw in which there is an upper wire 12*a* and a lower wire 12*b*, an upper row 10*a* of drying cylinders, a lower row of drying cylinders 10*a* and the web has free unsupported draws $W_0$ in the gaps between the rows of drying cylinders 10*a* and 10*b*.

The wire groups $R_1, \ldots, R_6, R_1, \ldots, R_{7D}$, in the dryer sections described above are surrounded by an isolated hood 15 above the floor level $T_1$ in the paper machine hall. The hood comprises vertical side walls 15*a* and 15*b* as well as a ceiling wall 15*c* and transverse vertical walls, of which only a rear wall 15*d* is shown in FIG. 2. The drying cylinders 10, 10', the reversing suction cylinders 11, 11' as well as the loops of the drying wires 12, 12*a*, the guide rolls 13 for the wires 12, 12*a*, the tending bridges and the stairways 14 between them remain inside the hood 15.

In FIG. 1, underneath the dryer section, at a distance corresponding to a difference in height $H_1$, which is from about 1.5 m to about 2 m, from the reversing suction cylinders 11 and from the drying cylinders 10' a ceiling wall 20 of the basement spaces B is arranged. The ceiling wall, at the same time, also operates as the lower wall of the upper hood spaces H, so that the moist hood spaces H can be isolated from basement spaces B, which are dry and, according to the invention, taken into effective and useful use. The ceiling wall is also referred to as a partition-wall construction as it separates and isolates the moist spaces from the dry, useful spaces. Solid beams 22*a*,22*b* of reinforced concrete or equivalent steel-box beams 22K are supported on the steel and/or concrete base which constitutes the floor plane of the basement spaces B. On the solid beams 22*a*, 22*b* or steel-box beams 22K, there are horizontal steel-box beams 21*a* and 21*b* or corresponding beams of reinforced concrete. The floor slabs 24*a*, 24*b* of the machine hall also rest on these horizontal beams 21*a*, 21*b*. Further, the vertical constructions include beams 23 placed outside the vicinity of the beams 22*a*, 22*b*, 22*k*, so that the floor slab of the paper machine hall are also partially supported on these outside beams 23. Above the floor plane $T_1$, outside the hood 15, there are the tending-side spaces 45H and the driving-side spaces 45K in the paper machine hall.

Referring again to FIG. 1, the ceiling wall construction 20 of the basement spaces B extends substantially and uniformly across the entire length of the dryer section, i.e., below all of the dryer groups $R_1, \ldots, R_6$. On the partition wall construction 20, a broke conveyor mat 30 is arranged to run around the reversing rolls 32*a* and 32*b* to the reel devices 31*a* and 31*b*, in the manner illustrated in FIG. 1. By means of the rolls 32*a*, 32*b* and reel devices 31*a*, 31*b*, the conveyor belt 30 of the broke conveyor can be operated in the machine direction so that the paper broke coming from the dryer section can be transferred either into an associated pulper 40*a* placed at the side of the press section or into a pulper 40*b* placed after the dryer section.

Figure 2A:
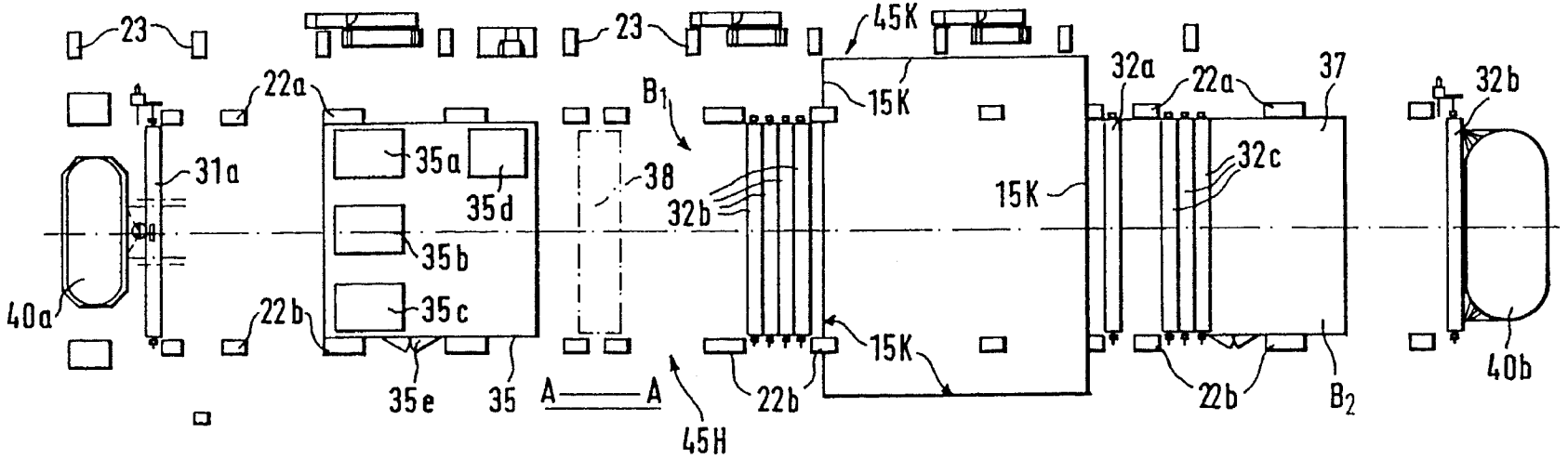
FIG. 2A is a horizontal sectional view taken along the line A—A in FIG. 2.

In FIGS. 2 and 2A, the basement space B underneath the dryer section is divided into two separate spaces $B_1$ and $B_2$ between which there is a so-called basement hood 15*k* situated substantially underneath the inverted group $R_{4K}$. In the interior of the basement hood 15*k*, there are guide rolls 13' for the drying wire 12' of the inverted group $R_{4K}$. The broke conveyor means has also been divided into two parts 30A, 30B, of which the first part 30A in the machine direction is arranged underneath the normal groups $R_1$, $R_2$ and $R_3$ to operate in conjunction with these dryer groups. The conveyor mat 30A of the broke conveyor runs around the ceiling wall 20A of the basement space $B_1$, while being guided by the reversing rolls 32*a* and 32*b*. In a corresponding manner, underneath the last two wire groups $R_5$ and $R_6$, above the basement space $B_2$, a ceiling wall 20B is arranged and the conveyor mat of the second broke conveyor 30B runs around this wall 20B while being guided by the reversing rolls 32*a* and 32*b* as well as by tensioning and alignment rolls 32*c*. The first broke conveyor mat 30A carries the paper broke coming from the groups $R_1$, $R_2$ and $R_3$ into the first pulper 40*a*, and the second broke conveyor mat 30B carries the paper broke coming from the groups $R_5$ and $R_6$ into the second pulper 40*b*.

If an inverted group is used in the dryer section, it is also possible to use a unified, substantially horizontal ceiling construction as shown in FIG. 1. In this case, the guide rolls of the inverted group are placed above the unified horizontal wall 20 at a level higher than their normal position. Alternatively, it is possible to raise the entire inverted group to a level higher than its normal level so that the drying wire running around the drying cylinders and guide rolls associated therewith are all situated above the horizontal partition wall 20.

Referring again to FIG. 1, the dry and air-conditioned basement spaces B, which have been isolated from the moist spaces H of the hood 15, are taken into useful use in accordance with the invention by, e.g., placing a room 35 fitted with a door 35*e* and possibly containing the hydraulic central units. As shown, the central units 35*a*, 35*b*, 35*c* are hydraulic central units, e.g., for the variable-crown roll (ZC-roll™) of the first, third and fourth press in the press section, and the unit 35*d* is the hydraulic central unit for the wet end of the machine. Further, in the compartment 36 in the basement spaces B, the circulation lubrication center for the dry end of the paper machine is placed. In this manner, the advantage is obtained that, from the center, shorter draws and lengths of lubricant pipes and shorter necessary cables are possible to the various lubrication, monitoring and measurement points. In addition, in the rearward end of the space B, there is a room 37 provided with a door 37*a*, in which some of the hydraulic systems of the dry end of the paper machine and means for heating of the heating fluid for the calender rolls, and possibly other equipment for the dry end, are placed.

FIG. 2A shows the basement hood 15*k* arranged underneath the inverted group $R_{4K}$ and which separates the air-conditioned and dry basement spaces $B_1$ and $B_2$ from one another. In space $B_1$, in addition to the room 35 of the hydraulic central unit, a felt storage space 38 is placed for storing felts.

Figure 3A:
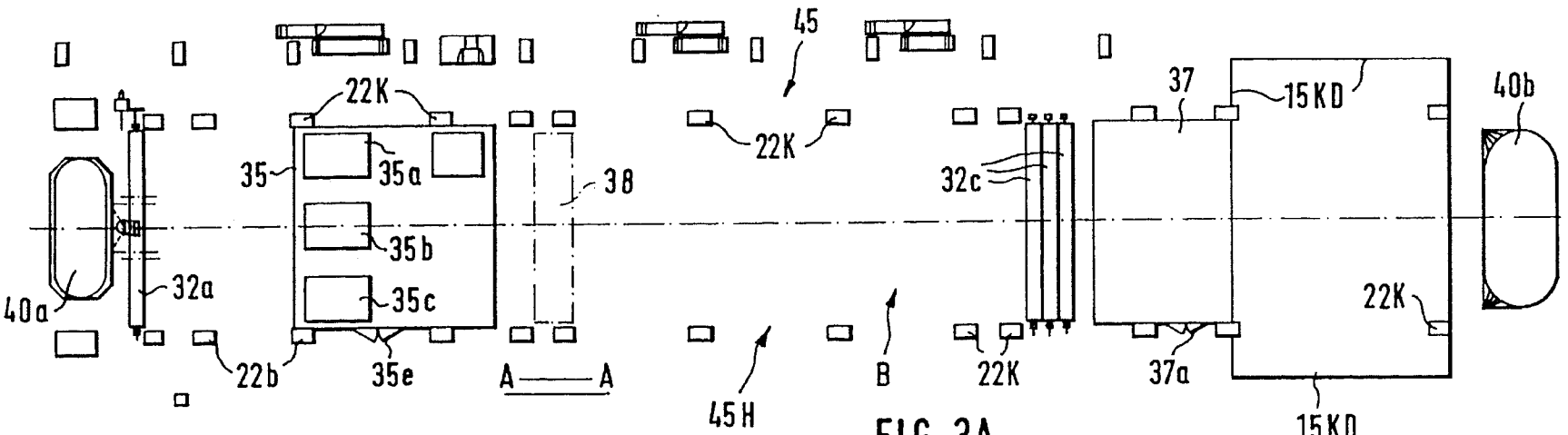
FIG. 3A is a horizontal sectional view taken along the line A—A in FIG. 3.

In FIG. 3A, underneath the group $R_{7D}$ having a twin-wire draw, there is a basement hood 15KD having an interior which is isolated from the dry and air-conditioned basement space B. The interior space 15KD in the basement hood communicates with the moist hood space H above the floor plane $T_1$ of the paper machine hall. The drying wire 12*b* and guide rolls are positioned within this hood 15KD.

Figure 3B:
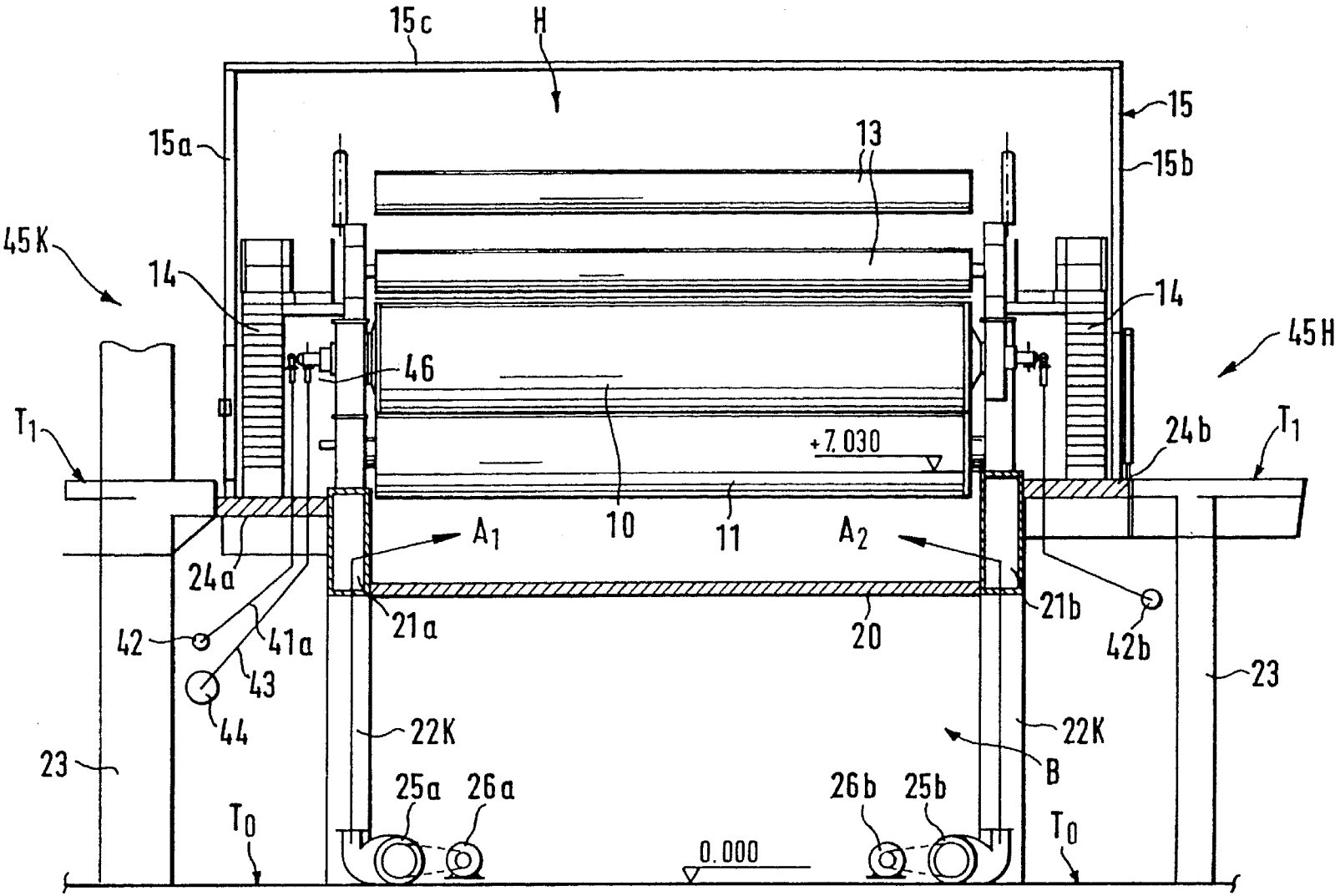
FIG. 3B is a transverse vertical sectional view taken along the plane B—B in FIG. 3.

In FIG. 3B, air blowers 25*a* and 25*b* are arranged in the airconditioned and dry basement spaces B underneath the dryer section. Blowers 25*a*,25*b* are driven by motors 26*a* and 26*b*. By means of the blowers 25*a* and 25*b*, air flows $A_1$ and $A_2$ are passed from the basement spaces B through the hollow interior of the steel-box beams 22*k* in the foundation constructions of the dryer section of the paper machine and into the moist hood space H. Thus, the vertical beams 22*k* in the steel base $T_0$ can be used effectively for a further purpose. The vertical beams 22*k* can be connected with horizontal, hollow box beams 21*a* and 21*b*, which can also be used as supply ducts for intake air for the interior H of the hood 15. FIG. 3B also shows distribution ducts 42*a* and 42*b* for the circulating lubrication fluid for the cylinders 10, 11, 10', 11' together with distribution pipes 41*a* and 41*b* departing from the distribution ducts to the lubrication points. In accordance with this arrangement, pipes 41*a*, 41*b* are shorter than in prior art dryer sections. Further, FIG. 3B shows electric cables and cable connectors 44 for the detectors 46 that monitor the condition of the bearings of the drying cylinders.

The foundation construction of the basement spaces B, $B_1$, $B_2$ described above is, particularly advantageously, made of modules, in which the vertical walls and possibly also the vertical columns are standardized prefabricated units.

In accordance with the invention, it is possible to fit into the useful spaces B, $B_1$, $B_2$, the devices mentioned above and other, corresponding devices in positions from which pipe and/or cable draws (or extensions) to various objects, such as hydraulic actuators, circulation-lubrication points, measurement detectors, regulation means, and/or electric motors are obtained which are as short as possible.

If necessary, the useful spaces B, $B_1$, $B_2$ are also provided with air-conditioning and heating devices.

The examples provided above are not meant to be exclusive. Many other variations of the present invention would be obvious to those skilled in the art, and are contemplated to be within the scope of the appended claims.

I claim:

1. Arrangement in a paper machine dryer section, said dryer section having a frame supported by structural members over a space in a paper machine hall, comprising a hood situated above a level of a floor in said paper machine hall, said hood surrounding the dryer section and confining moist spaces of the dryer section in an interior thereof, partition means arranged underneath the dryer section for separating the moist dryer section spaces confined in said hood interior from dry spaces situated underneath the dryer section, said dry spaces constituting at least one of storage spaces in which accessory devices of the paper machine are stored and installation spaces in which accessory devices of the paper machine are, installed, and conveyor means for disposing of paper broke from a web passing through the dryer section, said conveyor means being arranged above said partition means.

2. The arrangement of claim 1, wherein said partition means comprise a substantially horizontal partition-wall construction and said structural members comprise horizontal beams for supporting the frame of the dryer section and vertical beams for supporting said horizontal beams.

3. The arrangement of claim 1, wherein said partition means comprise a single partition-wall construction extending substantially across the entire length of the dryer section, said dry spaces being situated below said single partition-wall construction.

4. The arrangement of claim 1, wherein the dryer section includes at least one inverted dryer group having a single-wire draw in which drying cylinders are arranged in a first row spaced from leading rolls arranged in a second row, the arrangement further comprising a basement hood positioned below said inverted dryer group for isolating moist dryer section spaces in proximity to said inverted dryer group and the dryer section from said dry spaces, an interior of said basement hood communicating with the interior of said hood.

5. The arrangement of claim 4, wherein said basement hood divides the space underneath the dryer section into at least two parts, said conveyor means comprising a broke conveyor arranged in each of said parts.

6. The arrangement of claim 2, wherein said structural members further comprise a base of at least one of steel and reinforced concrete on which the vertical beams are supported, said base being situated in said dry spaces underneath the dryer section, said vertical beams supporting the floor of the paper machine hall.

7. The arrangement of claim 2, wherein at least some of the vertical beams are box beams having a hollow interior and aperture opening into at least one of said hood and the paper machine hall, the arrangement further comprising blowers connected to said hollow interior of said box beams for at least one of passing air into said hood and providing airconditioning for the paper machine hall.

8. The arrangement of claim 1, wherein said dry spaces are dimensioned to accommodate at least one of hydraulic central units for at least one variable-crown roll in a press section of the paper machine, hydraulic central units for a wet end of the paper machine, central units for circulation lubrication of a dry end of the paper machine, hydraulic central units for the dry end of the paper machine, centers for heating circulation fluid for calender rolls, blowers for air-conditioning of at least one of a hall of the paper machine and said hood of the dryer section, or air ducts for air-conditioning of at least one of a hall of the paper machine and said hood of the dryer section, felt storage spaces, measurement centers for the paper machine, regulation centers for the paper machine, and electric cables for measurement detectors and actuators.

9. The arrangement of claim 2, wherein said conveyor means comprise a broke conveyor having a conveyor mat and reel devices arranged at both ends of said conveyor mat, said conveyor mat being arranged to run over said partition wall construction.

10. The arrangement of claim 1, wherein said conveyor means comprise at least one broke conveyor having a closed conveyor-mat loop, and reversing wheels and guide rolls for guiding said loop.

11. The arrangement of claim 1, further comprising a pulper arranged at a forward end of said dry space for receiving the paper broke from said conveyor means.

12. The arrangement of claim 5, further comprising a first pulper arranged at a forward end of said dry space for receiving the paper broke from an adjacent one of said broke conveyors and a second pulper arranged at a rear end of said dry space for receiving the paper broke from an adjacent one of said broke conveyors.

13. The arrangement of claim 3, wherein the dryer section includes at least one inverted dryer group having a single-wire draw in which drying cylinders are arranged in a first row spaced from leading rolls arranged in a second row and a loop of a drying wire is guided by guide rolls to run below said drying cylinders and said leading rolls, said single partition-wall construction defining a ceiling of said dry spaces, and said guide rolls being positioned above said ceiling.

14. The arrangement of claim 1, wherein said dry spaces are partially defined by a base construction comprising modules having standardized prefabricated units which define vertical walls and vertical columns.

15. The arrangement of claim 1, further comprising a pulper arranged at a rear end of said dry space for receiving the paper broke from said conveyor means.

* * * * *